United States Patent [19]

Blanz

[11] 4,220,062

[45] Sep. 2, 1980

[54] MACHINE HAVING A PLURALITY OF RECIPROCATING WORKING TOOLS WHICH MAY BE SELECTIVELY BROUGHT INTO OPERATION

[75] Inventor: Karl Blanz, Stuttgart, Fed. Rep. of Germany

[73] Assignee: Trumpf Maschinen AG, Switzerland

[21] Appl. No.: 935,952

[22] Filed: Aug. 23, 1978

[30] Foreign Application Priority Data

Aug. 25, 1977 [DE] Fed. Rep. of Germany ..... 2738344

[51] Int. Cl.[3] ..... B26F 1/04

[52] U.S. Cl. ..... 83/71; 83/405; 83/549; 83/551

[58] Field of Search ..... 83/549–552, 83/71, 405

[56] References Cited

U.S. PATENT DOCUMENTS

| | | | |
|---|---|---|---|
| 3,449,991 | 6/1969 | Daniels | 83/552 X |
| 3,717,061 | 2/1973 | Daniels | 83/552 X |
| 3,895,550 | 7/1975 | Daniels | 83/551 X |
| 3,902,389 | 9/1975 | Brown et al. | 83/552 X |
| 3,921,486 | 11/1975 | Valente | 83/552 X |
| 3,951,026 | 4/1976 | Beauplat | 83/552 R |

*Primary Examiner*—Frank T. Yost

*Attorney, Agent, or Firm*—McGlew and Tuttle

[57] ABSTRACT

A machine which has a plurality of reciprocating work tools which may be selectively brought into operation, comprises, a plurality of tool holders, each adapted to hold a separate tool for reciprocative movement upwardly and downwardly, or a cooperating tool, for example, a moving punch, cooperating with a die. The machine advantageously includes sets of tool holders and dies which may be moved relatively to tool holders and dies of other sets so as to shift them relative to an operating mechanism for effecting reciprocation. The tools may be selectively positioned into coupling engagement with the reciprocating means so that some of the tools are not reciprocated and may, for example, be shifted or replaced.

8 Claims, 3 Drawing Figures

MACHINE HAVING A PLURALITY OF RECIPROCATING WORKING TOOLS WHICH MAY BE SELECTIVELY BROUGHT INTO OPERATION

FIELD AND BACKGROUND OF THE INVENTION

This invention relates in general to the construction of a machine having a plurality of reciprocating working tools which may be selectively brought into operative engagement with reciprocating means for permitting the operation of one tool while another may be repositioned or replaced.

DESCRIPTION OF THE PRIOR ART

Machines with reciprocating working tools have been known for some time. If a punch press is concerned, the tool equipment comprises at least one punch and one die. If the tool is worn down, the press is stopped and the tool is exchanged. Thereupon, the same workpiece, or another workpiece is machined. Basically, the time elapsed between the two operations is an idle time and, for this reason, attempts have been made to reduce the tool exchange period by suitable devices and by a particular design of the tool and the corresponding mechanisms fo coupling the tool parts to the machine. Even if the interruption between two operations takes only a few seconds, the machining of complicated workpieces, requiring a frequent change of tools, may result in a considerable total loss of time which will be calculated in fragments of hours per day.

SUMMARY OF THE INVENTION

The present invention is directed to a machine tool in which the time elapsed between the working operations due to a sequential use of tools is reduced to an absolute minimum and, if possible, to zero.

To this end, and in accordance with the invention, a machine tool is provided which has a plurality of interconnectable tool drives and tool support. In such a machine tool, the second or even further tools can be inserted or exchanged for new ones while the first tool is still working. As the work of the first tool is terminated, the workpiece is positioned correctly relative to the second tool which can start its work instantly. The time required for displacing the workpiece from its present position to the next position is, in any case, shorter than the time needed for the tool exchange operation in machines of the prior art.

Taking also into account that the workpiece will be machined by the next tool, as a rule, at another location than during the preceding operation, there is a 50:50 chance that during the displacement of the workpiece from the first tool to the second tool, and from the second tool to the third tool, etc., due to the lateral spacing of the two tools, a shorter distance will be covered than with a conventional machine tool which does not require such a lateral compensation.

The tool support means may comprise a plate, a frame, or the like, supporting a plurality of tools which, in the case of a punch press, as mentioned, each comprise at least two parts. In this latter case, the tool supporting means may also be designed in two parts, one part supporting the punches and the other part supporting the dies. It is possible, however, in a particular design, to also use in such instance an integral tool supporting means on which the tools are arranged in the same manner, and the tool parts may be spaced from each other exactly by the same distance as in a two-part tool supporting means. In this connection, it is irrelevant how the tool supporting means moves during the changing of tools.

The movable machine coupling mechanisms are suitably designed receiving structures in which the reciprocating tool or tool part, i.e., in a punch press, the punch can be locked. It should be expressly noted in addition that the term "drive" does not necessarily cover, but may also cover, the drive motor.

Another solution of the problem underlying the invention and provided in a machine tool is a design in which a single connectable and disconnectable drive is required for the reciprocating motion, thus, for example, the strokes, of the working tool or tool part. In addition, with the work of the one tool terminated, the machine coupling mechanism executes a change motion which is transverse to the working or effective direction, and is coupled to the next tool or tool part provided for machining the workpiece.

The machine coupling mechanism may be connected and particularly designed in a simple manner such that, simultaneously with the change motion taking place transversely to the working direction, it is disengaged from the presently used tool and is engaged with the next required tool. One of the possible mechanical connections suitable in this regard is the dovetail connection or a T-groove. If no positive locking is provided and the machine coupling mechanism only comes into a bearing contact with the ram, the ram must be reset by means of a spring since, in such a case, tensional forces cannot be transmitted.

In both the first and second solutions to the problem, the second tool support means is displaced, turned or otherwise moved, while work is done with one of the tools of the first tool support means, and inversely. Similar conditions are given with the provision of three or more tool supporting means, and if three such means are provided, the second and third may be moved simultaneously or sequentially until the next required tool comes into the correct position relative to the machine coupling mechanism.

Another development of the invention provides that the tool supporting parts of a tool support means, which is made in at least two parts, i.e., comprising supporting punches and dies, are displaceable relative to each other in a rectilinear parallel motion. In such a design, the supports are elongated tool magazines in which the selectively usable tools or tool parts are accommodated along at least one straight line.

Another variation of the invention provides that the tool supporting parts carrying punches on the one hand, and dies on the other hand, are coaxial with each other and each extend in the respective same plane, with all of the tool parts or one tool supporting part being arranged along a circle and the lateral spacing from each other of the adjacent concentric circles corresponding to the lateral spacing from each other of adjacent machine coupling mechanisms, and that the tool supporting parts of each tool supporting means which are associated with each other are also arranged coaxially. Thus, in this design, the tool supporting parts cannot be displaced back and forth in a straight line, but are rotatable. A rotary drive in both directions is preferable, since it ensures the fastest alighment of the respective required tool relative to the machine. In addition, in all multipart tool supporting means the respective corresponding parts of the tool support means extend in the same planes. That is, with such a provision, only a unidimensional motion of the tool support means is needed for the tool change.

According to a further development of the invention, each punch drive may be connected to a common drive motor through its own clutch. The clutch may be of a conventional electromagnetic or hydraulic design. Of course, it is also possible to use other known kinds of clutches. This embodiment is particularly advantageous in high performance machines since it only requires one of the expensive drive motors.

In another embodiment of the invention, it is provided that the punch drives can be alternately coupled to the ram which is displaceable transversely to the punch stroke direction and connected to a drive motor. Thus, in this design, the motor is not stationary and is always displaced toward the drive to be actuated next. It is advisable, of course, to associate the displacement of the motor with an automatic coupling and uncoupling in the above-mentioned manner.

Another development of the invention provides a positioning device which acts on the machine table, workpiece holder, etc., and compensates for the lateral or radial spacing of the axes of the tools supported in the machine coupling mechanisms. This positioning device may comprise simple stops between which a machine table, for example, of a twin press, is moved back and forth to align the workpiece relative to the working tool in each instance. This motion may be effected manually or automatically. In an effort to save time, a manual displacement might not be practical.

In a still further development of the invention, the machine tool is designed as a coordinate table punching machine with a numerical control, with the positioning device being connected to the numerical control. If, for example, the first punch has accomplished its last working stroke, the numerical control automatically causes an uncoupling of the first punch and the coupling of the second punch. This, of course, must be preceded by bringing the workpiece in its new position. During the displacement of the work, the numerical control automatically takes into account that the second tool is spaced by a finite lateral distance from the first tool. While preparing the program, the lateral spacing of the two consecutively working tools is included into the distance to be covered by the workpiece while moving from one working location to the other.

The use of a numerical or other control offers an additionally advantageous possibility, namely, that a corresponding instruction to the positioning device may be initiated by dialing the specific machine coupling mechanism. In other words, the workpiece may be positioned correctly, in a wellknown manner, through the numerical control or automatics of the inventive machine tool, while simultaneously taking into account the lateral displacement needed for the change from the tool of one tool support means to the tool of another tool support means. Also, at a predetermined instant, the control starts the drive of the tool which is to do the work.

Accordingly, it is an object of the invention to provide a machine having a plurality of reciprocating working tools, which comprises a machine frame, a plurality of tool holders which are adapted to hold a separate tool for reciprocation therein mounted on said machine frame for movement thereon and including a workpiece holder which is mounted on the machine frame for movement relative to the tools, perpendicular to the reciprocation thereof, for shifting the workpiece to permit the tools to act on the workpiece during reciprocation, and which also includes a reciprocating member, such as a ram, which may be selectively coupled to one or more tools so as to leave one tool free for exchange or readjustment.

A further object of the invention is to provide a machine having a plurality of reciprocating working tools which may be selectively brought into operation, which is simple in design, rugged in construction and economical to manufacture.

For an understanding of the principles of the invention, reference is made to the following description of typical embodiments thereof as illustrated in the accompanying drawings.

DESCRIPTION OF THE PREFERRED EMBODIMENTS

Figure 1:
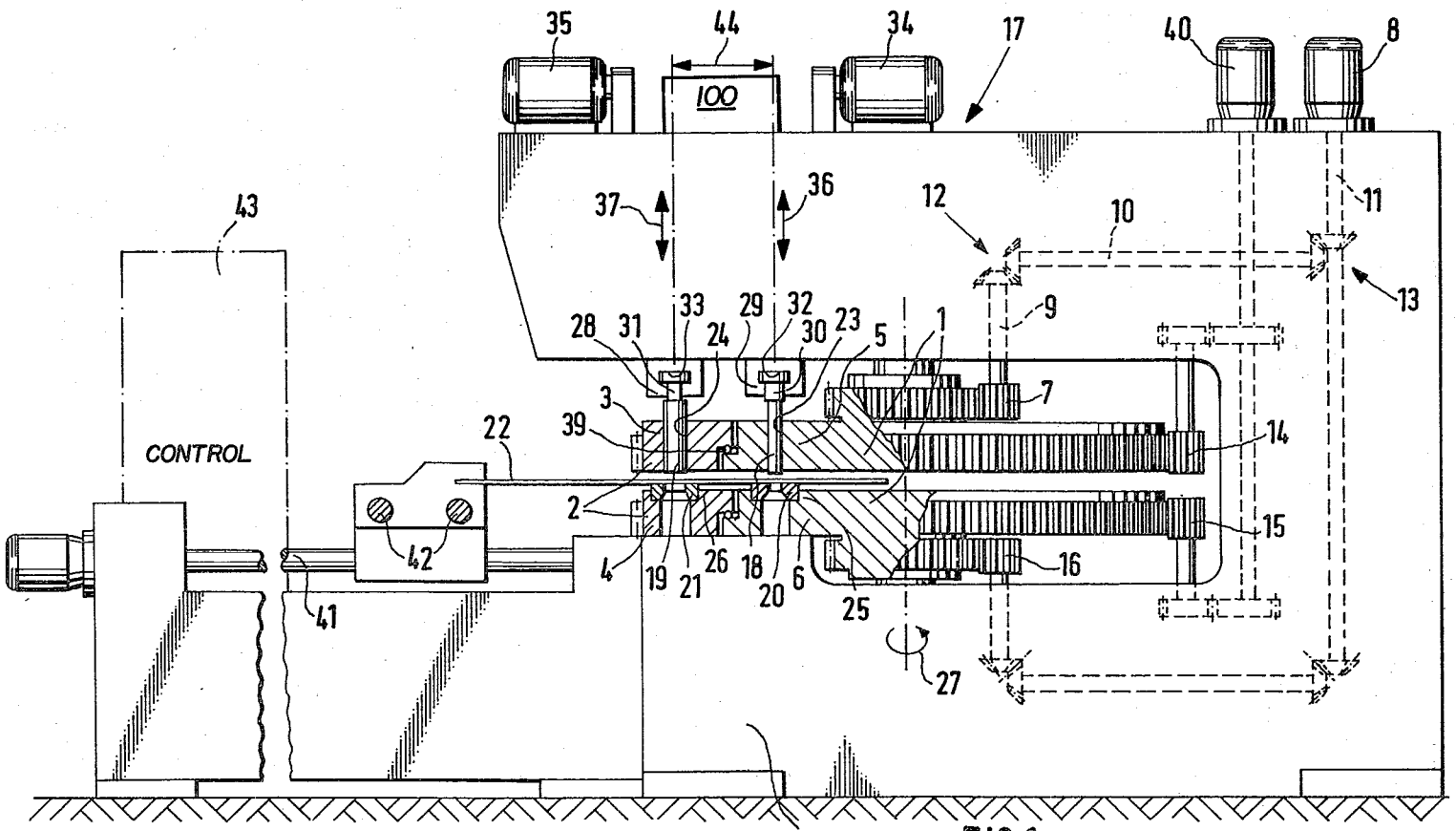
FIG. 1 is a side elevational view, partly in section, of a punch machine, constructed in accordance with the invention.

Referring to the drawings in particular, the invention embodied therein, in FIG. 1, comprises a machine, such as a punch or nibbling machine, which includes a plurality of tools 18 and 19 which are mounted in separate holders, such as holders 5 and 3, so that they may be shifted with the holders relative to reciprocating means, generally designated 100, which may be coupled through couplers 28 and 29, respectively, so as to permit one to operate while the other is idle so that it may be changed or replaced. Reciprocating means 100 may, for example, comprise a reciprocating ram, having portions which may be selectively aligned with the coupling element 28 or 29 so as to reciprocate the tools 19 and 18 which, for example, may comprise punches, which cooperate with dies 21 and 20, respectively.

The first embodiment, shown in FIG. 1, provides two tool support means which each comprise two parts, mounted for rotation, with the annular tool support parts 3 and 4 of first tool support means 2 concentrically surrounding the disc-shaped tool supporting parts 5 and 6 of the second tool support means 1. Tool support parts 3 and 5 extending substantially at the same level, as do the tool supporting parts 4 and 6. The second tool supporting part 5 is driven for rotation through a pinion 7 connected to a drive motor 8. The purely mechanical connection provided in this embodiment is shown in the form of a train of drive shafts 9, 10 and 11, and bevel gears 12 and 13. The actual drive may, of course, be conventional and differ from the illustrative showing. The same applies to the drives of tool supporting parts 3, 4 and 6. In FIG. 1, the first tool support part 3 is associated with a drive pinion 14, tool supporting part 4 with a drive pinion 15, and tool supporting part 6 with a drive pinion 16. In this way, it is ensured that the tool supporting parts of one and the same tool supporting means 2 or 1 rotate in synchronism, in the same direction, and at the same speed.

A plurality of punch tools, selectively usable in the punch press 17 are supported in both tool supporting means 2 and 3. Each tool comprises at least one punch 18 or 19, and a corresponding die 20 or 21. Punch 18 and die 20 form one punch tool and punch 19 and die 21 form another punch tool. Tool supporting means 1 and 2, at the same time, hold and guide punch tools 18 and 20, or 19 and 21. During the working operation on a workpiece 22, for example, a metal sheet, the tool support means in which the respective tool is received must not be moved or rotated. The upper tool supporting parts 3 and 5 are each provided with a longitudinal guide or bore 23 and 24 or a corresponding recess for each punch 18 and 19. The lower parts 4 and 6 comprise retaining means 25 and 26 for a removable insertion of dies 20 and 21, respectively.

While workpiece 22 is machined, for example, with tool 18 or 20, tool support means 2 can be rotated in the direction of arrow 27, or also in the opposite direction, until the tools 19 or 21, needed for the next working operation, comes into its working position. Then, during the working operation with tool 19 or 21, tool support means 1 may be readjusted.

Both punch 18 and punch 19 are to be coupled to the machine. For this purpose, the inventive machine tool is equipped with selectively coupled reciprocating means 100 which are aconnectable with machine coupling mechanisms 28 and 29 corresponding in number to the number of tool supporting means. The coupling mechanisms are shown only diagrammatically since their construction in detail is irrelevant and any of the known machine coupling mechanisms can be used, but they are oriented so as to be selectively engageable with a chosen tool to reciprocate it.

In the embodiment of FIG. 1, it is assumed that punches 18 of tool support part 5, and punches 19 of tool support part 3 have cylindrical portions 30 and 31 on their ram ends, terminated with an enlarged head which engage a T-groove 32 and 33 of coupling mechanism 28 and 29, making it possible to insert and remove the punch in a direction perpendicular to the drawing plane. Machine coupling mechanisms 28 and 29 are either connected to the rams of this machine tool for moving therewith, or they directly form these rams which can be reciprocated by means of a drive motor 34 and 35 in the direction of double arrows 36 and 37. These drives for the reciprocating working motion are of a conventional design.

In order to absorb the punch forces, tool support parts 4 and 6 are mounted for bearing on underframe or lower frame portion 38 of the machine tool. Also, the bearings must be appropriately designed to keep the annular tool supporting part 4 permanently in concentrical position relative to tool supporting part 6. Tool supporting part 3 may be guided for rotation on tool supporting part 5 and is thereby secured against axial and radial motion. This is indicated diagrammatically by a ball bearing 39. The drive motor for tool supporting means 2 or parts 3 and 4 thereof is shown at 40. Workpiece 22 can be displaced in any direction in the plane of the sheet by means of longitudinal guides 41 and cross-guides 42. These motions are mostly program-controlled and, for this purpose, the machine tool is equipped with a control 43 wherefrom all of the control pulses for the drive motors of the punches and tool supporting means are also given.

Punches 18 and 19 and dies 20 and 21 are spaced from each other by a predetermined lateral distance 44. If the operation is now to be transferred from one tool 18 or 20 to the next tool 19 or 21, workpiece 22 must be displaced, as viewed in FIG. 1, from the right to the left through the distance 44. If the work is then continued with a tool of tool support means 1, the displacement through the distance 44 is effected in the opposite direction, from the left to the right. Advantageously, this displacement is effected automatically through the machine control.

In this connection, it is to be kept in mind that, as a rule, the subsequently working tool does not start its work at the location of the workpiece where the preceding tool stopped, but rather at another location of the workpiece. Consequently, while transferring from one tool to the other, a displacement is necessary in any event. This displacement is superimposed by the displacement needed because of the lateral distance 44. This can be taken into account in the program of a program-controlled machine. Therefore, it might easily happen that the distance from one working location to the next to be covered by the workpiece becomes shorter due to the lateral distance 44 than it would be in a machine having a single tool supporting means.

Figure 2:
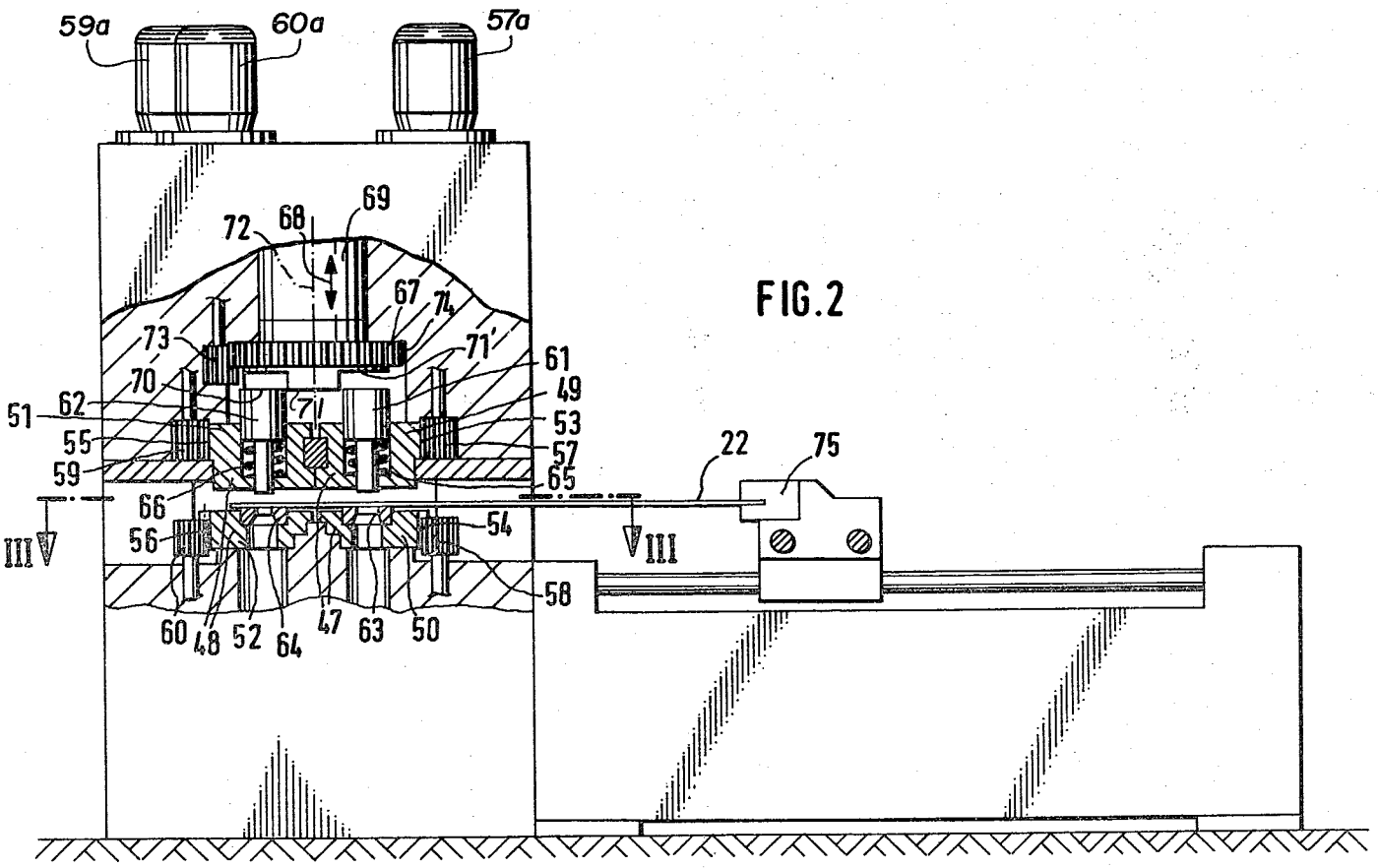
FIG. 2 is a view, similar to FIG. 1, of another embodiment of the invention.
Figure 3:
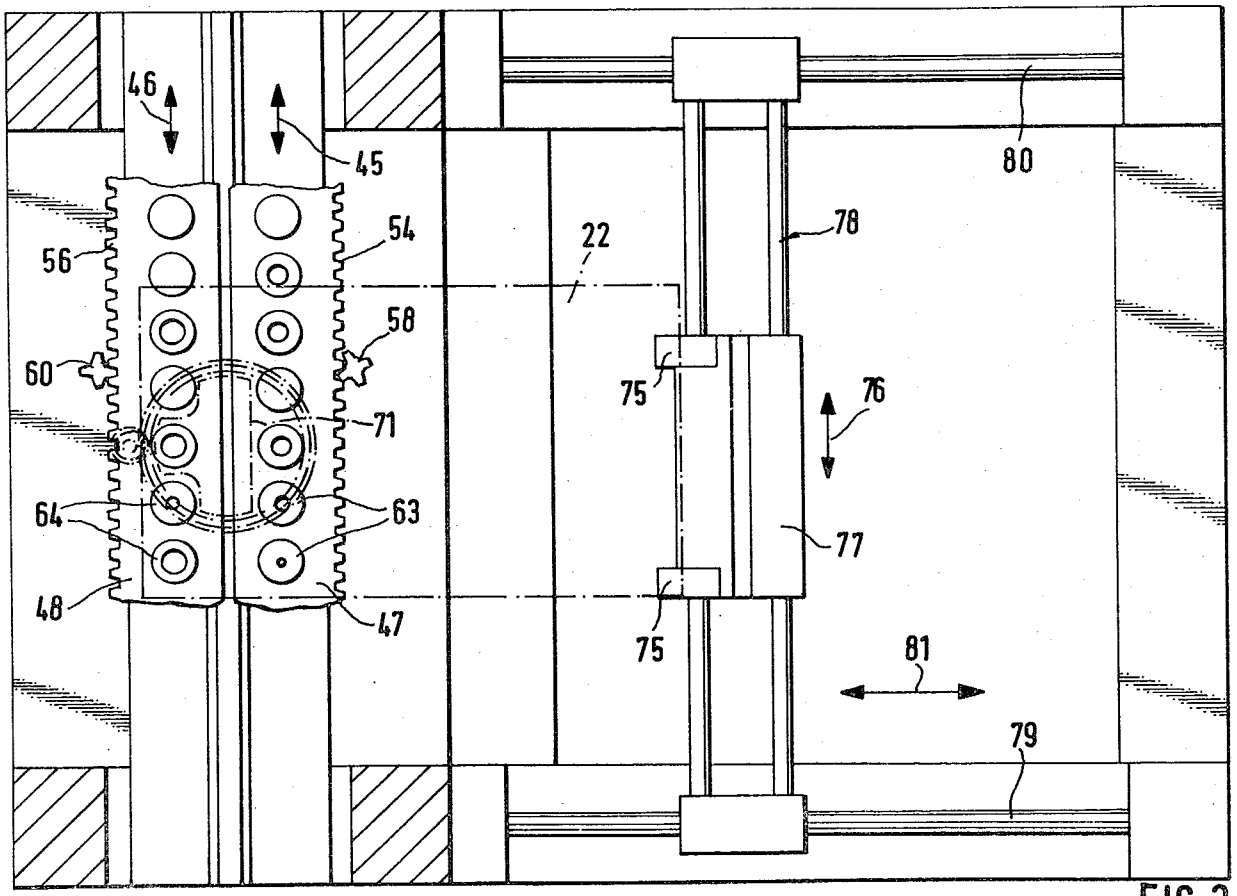
FIG. 3 is a partial plan view taken along the lines III—III of FIG. 2.

In the embodiment of FIGS. 2 and 3, elongated tool supporting means 47 and 48 which are displaceable in the directions of double arrows 45 and 46 are used, and they are each also made in two parts, as shown in FIG. 2. Tool supporting or support parts 49 and 50 of tool support means 47 are driven by respective pinions 57 and 58 through a gear rack 53 and 54 formed on respective supporting means, while for the longitudinal displacement of tool supporting parts 51 and 52 of tool supporting means 48, the same purpose is served with racks 55 and 56 which are driven by respective pinions 59 and 60. Pinions 57, 58, 59 and 60 are connected to respective drive motors **57*a*, 58*a*, 59*a* and 60*a* in a suitable and well-known manner. Measures are taken to always displace upper tool supporting parts 49 and 50, on the one hand, and lower tool supporting parts 51 and 52**, on the other hand, in the same direction, in synchronism, and at equal speeds.

Tool supporting parts 49 and 51 receive respective punches 61 and 62 and, if any, also hold-down means or strippers, while dies 63 and 64 are supported on respective parts 50 and 52. In this embodiment, punches 61 and 62 are displaceable downwardly, i.e., in the working direction, against the action of a respective return spring 65 and 66. Consequently, a coupling by means of a T-section groove as in the embodiment of FIG. 1 can be omitted. In the present embodiment, the machine coupling mechanism 67 is formed by the lower end of the ram 69 which is reciprocable in the direction of double arrow 68 and whose free end face 71 butts or can butt against the opposite end face 70 of the respective working punch.

Since this construction provides a common machine coupling mechanism for both punches working consecutively, of which, however, only one at a time is coupled, this machine coupling mechanism 67 is provided with a corresponding segmental recess 71', longitudinal slot, etc., extending perpendicularly to the drawing plane and preventing, in the position shown in FIG. 2, a simultaneous drive of punch 61. At the same time, this recess allows the displacement of tool supporting means 47 while a tool of tool supporting means 48 is working, and inversely. While transferring from a tool of tool supporting means 47 to a tool of tool supporting means 48, the machine coupling mechanism 67 of this variant of the invention must be turned about its axis 72 through 180°. This is effected, for example, by a pinion 73 meshing with the teeth of a gear rim 74 provided on the circumference of machine coupling mechanism 67. This drive if, of course, merely an example. However, if actually designed in this manner, care must be taken to ensure that the teeth of pinion 73 are long enough so that they do not disengage from those of gear 74 during the up and down motions. Instead of a rotary machine coupling mechanism, a mechanism mounted on ram 69 for displacement in a direction perpendicular to double arrow 68 might also be provided. Such a design would be useful particularly if more than two tool supporting means 47, 48 would be provided adjacent each other.

The workpiece 22, in the embodiment of FIGS. 2 and 3, is held in clamping shoes 75 provided on a sliding head 77 which is displaceable in the transverse direction 76 and is also guided for reciprocating movement on longitudinal guides 79 and 80, by means of a carriage, generally designated 78, and in the direction of double arrow 81. In the embodiment of FIGS. 2 and 3, the common drive is provided for both driving the punch just in use of tool supporting means 47, and for driving a punch of tool supporting means 48.

It is possible and may be advantageous to simultaneously drive two punches which might be in working positions at the same time, for example, by turning the machine coupling mechanism 67 about its axis 72 through 90°, however, this is not provied. The drive is connected to a specific tool quasi simultaneously with the coupling of the tool to ram 69. As shown in the embodiment, the term "coupling" is to be interpreted in this connection as also covering actions in which a force is transmitted from the ram to the punch only in the working direction.

While specific embodiments of the invention have been shown and described in detail to illustrate the application of the principals of the invention, it will be understood that the invention may be embodied otherwise without departing from such principles.

What is claimed is:

1. A machine having a plurality of reciprocating working tools, comprising a machine frame, a first tool holder mounted on said frame for displacement backwardly and forwardly on said frame, a first die holder arranged below said tool holder for movement on said frame backwardly and forwardly below said first tool holder, a second tool holder mounted for movement parallel to said first tool holder backwardly and forwardly on said frame, a second die holder mounted below said second tool holder for movement on said frame backwardly and forwardly below said second tool holder, drive means connected to each of said first and second tool holders and first and second die holders for shifting them along said frame and for selectively aligning a die with a selected tool of each of said first and second tool holders and die holders, workpiece holding means mounted on said frame for movement backwardly and forwardly thereon and longitudinally therealong, means connected to said workpiece holder for moving said holder to present a workpiece between said respective first and second tool holders and first and second die holders for operation thereon by the tools in cooperation with their respective die, reciprocating means on said frame mounted above said tool holder including a ram engageable with respective tools in said tool holders which are aligned therewith to reciprocate said tools, means for shifting said ram to change the orientation thereof in respect to the tools for operating on selective ones of said tools.

2. A machine having a plurality of reciprocating working tools, comprising, a machine frame, a plurality of tool holders, each adapted to hold a separate tool for reciprocating movement therein, said tool holders being mounted on said frame for movement, work piece holder means mounted on said machine frame for movement relative to said tools perpendicular to the direction of reciprocation of said tools for shifting the workpiece to permit the tools to act thereon during reciprocation of said tools, reciprocating means on said frame for reciprocating a tool, and means for moving said tool holders relative to said reciprocating means to selectively engage a tool with said reciprocating means for actively reciprocating said tool while at least one of said tools does not reciprocate, said plurality of tool holders comprising at least two holders rotatably mounted for rotation about the same axis, a tool mounted in each of said holders for reciprocation therein parallel to the axis of rotation, said reciprocating means being mounted on said machine frame for reciprocation above said tools, first and second coupling members conected to said reciprocating means between said reciprocating means and said tool, and means to drive said holders selectively so as to position a selective one of said tools in alignment with a respective one of said first and second couplers to effect reciprocation thereof by a coupling engagement of the tools with said reciprocating means.

3. A machine having a plurality of reciprocating working tools, comprising, a machine frame, a plurality of tool holders, each adapted to hold a separate tool for reciprocating movement therein, said tool holders being mounted on said frame for movement, work piece holder means mounted on said machine frame for movement relative to said tools perpendicular to the direction of reciprocation of said tools for shifting the workpiece to permit the tools to act thereon during reciprocation of said tools, reciprocating means on said frame for reciprocating a tool, and means for moving said tool holders relative to said reciprocating means to selectively engage a tool with said reciprocating means for actively reciprocating said tool while at least one of said tools does not reciprocate, said plurality of tool holders comprising first and second longitudinal elongated tool holders mounted on said machine frame for parallel movement relative to each other in respective opposite directions and drive means connected to said first and second holder members to shift said holder members in equal and opposite directions relative to said reciprocating means.

4. A machine, as claimed in claim 3, wherein said reciprocating means comprises a reciprocating ram, said ram having a recess portion and an end face engageable with a respective tool, the recess portion accommodating another of said tools so that said ram does not engage said tool to reciprocate it.

5. A machine having a plurality of reciprocating working tools, comprising, a machine frame, a plurality of tool holders, each adapted to hold a separate tool for reciprocating movement therein, said tool holders being mounted on said frame for movement, work piece holder means mounted on said machine frame for movement relative to said tools perpendicular to the direction of reciprocation of said tools for shifting the workpiece to permit the tools to act thereon during reciprocation of said tools, reciprocating means on said frame for reciprocating a tool, and means for moving said tool holders relative to said reciprocating means to selectively engage a tool with said reciprocating means for actively reciprocating said tool while at least one of said tools does not reciprocate, said plurality of tool holders comprising at least two first and second holders and two first and second die holders, each of said tool holders including at least one reciprocating tool and each of said die holders including at least one die cooperable with said tool, and means for moving said tool holders and said die holders with each other in parallel rectilinear motion.

6. A machine having a plurality of reciprocating working tools, comprising, a machine frame, a plurality of tool holders, each adapted to hold a separate tool for reciprocating movement therein, said tool holders being mounted on said frame for movement, work piece holder means mounted on said machine frame for movement relative to said tools perpendicular to the direction of reciprocation of said tools for shifting the workpiece to permit the tools to act thereon during reciprocation of said tools, reciprocating means on said frame for reciprocating a tool, and means for moving said tool holders relative to said reciprocating means to selectively engage a tool with said reciprocating means for actively reciprocating said tool while at least one of said tools does not reciprocate, said workpiece holder means including means for shifting said workpiece longitudinally and transversely relative to said tools, and control means for shifting the workpiece and effected to shift the workpiece when changing from the drive and reciprocation of one tool to the drive and reciprocation of another tool, so as to compensate for the difference in position of the location of the tool relative to the workpiece when changing from one tool to another.

7. A machine, as claimed in claim 6, wherein said machine is designed as a coordinate table punch press, said control comprising a numerical control connected to said workpiece holder means for shifting the workpiece holder.

8. A machine having a plurality of reciprocating working tools, comprising, a machine frame, a plurality of tool holders, each adapted to hold a separate tool for reciprocating movement therein, said tool holders being mounted on said frame for movement, workpiece holder means mounted on said machine frame for movement relative to said tools perpendicular to the direction of reciprocation of said tools for shifting the workpiece to permit the tools to act thereon during reciprocation of said tools, reciprocating means on said frame for reciprocating a tool, means for moving said tool holders relative to said reciprocating means to selectively engage a tool with said reciprocating means for actively reciprocating said tool while at least one of said tools does not reciprocate, and coupler means for selectively coupling said tool to said reciprocating means and control means connected to said workpiece holder means for moving said workpiece in accordance with the coupling mechanism which is employed.

* * * * *